US005313972A

United States Patent [19]

Goldberg

[11] Patent Number: 5,313,972

[45] Date of Patent: May 24, 1994

[54] TENT ASSEMBLY FOR VEHICLES AND PEOPLE

[76] Inventor: John Goldberg, 236 Oak St., Carpentersville, Ill. 60110

[21] Appl. No.: 672,525

[22] Filed: Mar. 19, 1991

[51] Int. Cl.[5] ..... E04H 15/06

[52] U.S. Cl. ..... 135/88; 135/116

[58] Field of Search ..... 135/88, 87, 97, 90, 135/96, 114, 115, 116, 119, 117

[56] References Cited

U.S. PATENT DOCUMENTS

| | | | |
|---|---|---|---|
| 1,185,981 | 6/1916 | Campbell et al. | 135/88 X |
| 1,394,579 | 10/1921 | Purcell | 135/88 |
| 1,741,424 | 12/1929 | Lundstrom | 135/88 |
| 1,803,237 | 4/1931 | Crooke | 135/88 |
| 1,825,183 | 9/1931 | Frisby | 135/88 |
| 2,480,509 | 8/1949 | Ripley | 135/88 |
| 2,826,210 | 3/1958 | Heil | 135/88 X |
| 4,109,954 | 8/1978 | Wall | 135/88 X |
| 4,114,633 | 9/1978 | Herbez | 135/88 |

FOREIGN PATENT DOCUMENTS

| | | | |
|---|---|---|---|
| 0641889 | 1/1964 | Belgium | 135/88 |
| 2903113 | 8/1979 | Fed. Rep. of Germany | 135/88 |
| 1603334 | 11/1981 | United Kingdom | 135/88 |

*Primary Examiner*—Carl D. Friedman
*Assistant Examiner*—Lan C. Mai
*Attorney, Agent, or Firm*—Wallenstein, Wagner & Hattis

[57] ABSTRACT

A tent assembly (10) for sheltering a personal riding vehicle and one or more people that is lightweight, compact and easy to set up is disclosed. The tent assembly (10) comprises a floor section (12) having one side (14) secured to the ground along side a parked vehicle and extending away from the vehicle, a wall section (32) connected to the side (16) of the floor section (12) farthest from the vehicle and a roof section (44) extending from the top of the wall section (32) over the floor section (12) and over the vehicle. The roof section (44) is secured to either the vehicle or to the ground on the opposite side of the vehicle from the floor section (12) and is supported at one side (46) by the wall and at an intermediate portion (50) by the vehicle. Storm flaps (52) may be connected to either end (70,72) of the roof section (44). The storm flaps (52) extend down to the floor section (12) and can be secured to the floor section (12), wall section (32) and vehicle, to further enclose and protect the inside of the tent assembly.

23 Claims, 2 Drawing Sheets

TENT ASSEMBLY FOR VEHICLES AND PEOPLE

TECHNICAL FIELD

The present invention relates generally to portable shelters, and more particularly, to tent assemblies which incorporate a personal riding vehicle as part of the structure, and provide shelter for the personal riding vehicle and one or more people.

BACKGROUND ART

The prior art is replete with portable tent constructions for people or for equipment and machinery. Only a few such structures are designed to not only provide shelter for a person but also enclose or incorporate a personal riding vehicle within the structure.

A two compartment tent assembly which encloses and uses a motorcycle as partial support is disclosed in U.S. Pat. No. 4,114,633. The tent disclosed in that patent is designed in the form of a penthouse which is mounted against the side of a motorcycle. A separate roof section is used to cover and enclose the motorcycle, which is completely outside of the penthouse. The occupants of the tent are separated from the motorcycle by a vertical wall mounted against the motorcycle within the tent. It is evident that the setting up of this structure is complicated and, further, requires special attachments that must be mounted on the motorcycle. These attachments, along with the additional roof section, add to the packed size and weight of the tent. Also, the vertical wall in the tent that is mounted against the motorcycle forms a barrier so that heat generated by the motorcycle engine cannot effectively warm the tent.

Accordingly, there is a need for a tent construction that can be easily carried by people and transported on vehicles, such as motorcycles, that is lightweight and compact so as to fit in limited storage areas. Also, there is a need for an uncomplicated structure that is easy to assemble and keep in good repair.

SUMMARY OF THE INVENTION

The assembly of the present invention provides a shelter for both a personal riding vehicle, such as a motorcycle or a bicycle, and one or more people. The assembly incorporates the vehicle as part of the support structure. It has also been found that the assembly is easy to set up and is compact when folded and not in use.

According to the invention, the tent comprises a floor section which has one side secured to the ground along the side of a parked vehicle, extends outward away from the vehicle and is secured to the ground at the other side. The floor section can also be tied to the vehicle. A wall section is connected to the floor at the side farthest from the parked vehicle and extends upwards to a height that is lower than the height of the vehicle. A roof section is connected at one side to the top edge of the wall section and extends over the floor section. The roof section further extends over the vehicle where a portion of the roof section conforms to the shape of the upper portion of the vehicle. The other side of the roof section is secured to either the vehicle or the ground on the side of the vehicle opposite the floor section. Thus, the vehicle provides partial support for the roof section.

The invention can also include storm flaps which are connected to both ends of the roof section and extend downward to the floor section. The storm flaps are provided with means to secure them to the vertical wall, floor section and vehicle to provide a dry, weatherproof shelter. These securing means may, for example, be zippers, hook and loop material, or ties connected to the edges of the storm flaps. Other conventional securing means may also be used.

The tent assembly can be made out of a non-rigid, fireproof, and water and mildew resistant material. Thus, it will keep the shelter dry and will not burn upon contact with hot pipes or other engine parts in the vehicle. This allows a hot engine to warm the inside of the tent assembly.

This structure has the advantage of not requiring any special attachments which need to be secured to the vehicle to support the tent assembly. Another advantage of this invention is that when not set up, the tent assembly can be rolled up and easily stored. The low height of the wall section imparts a pitch to the roof which will permit water to run off the structure during rain showers. Also, it is virtually impossible to steal a vehicle used with this invention without collapsing the tent assembly and waking the inhabitants. Other advantages and aspects of the invention will become apparent upon making reference to the specification, claims and drawings to follow.

DETAILED DESCRIPTION

Figure 1:
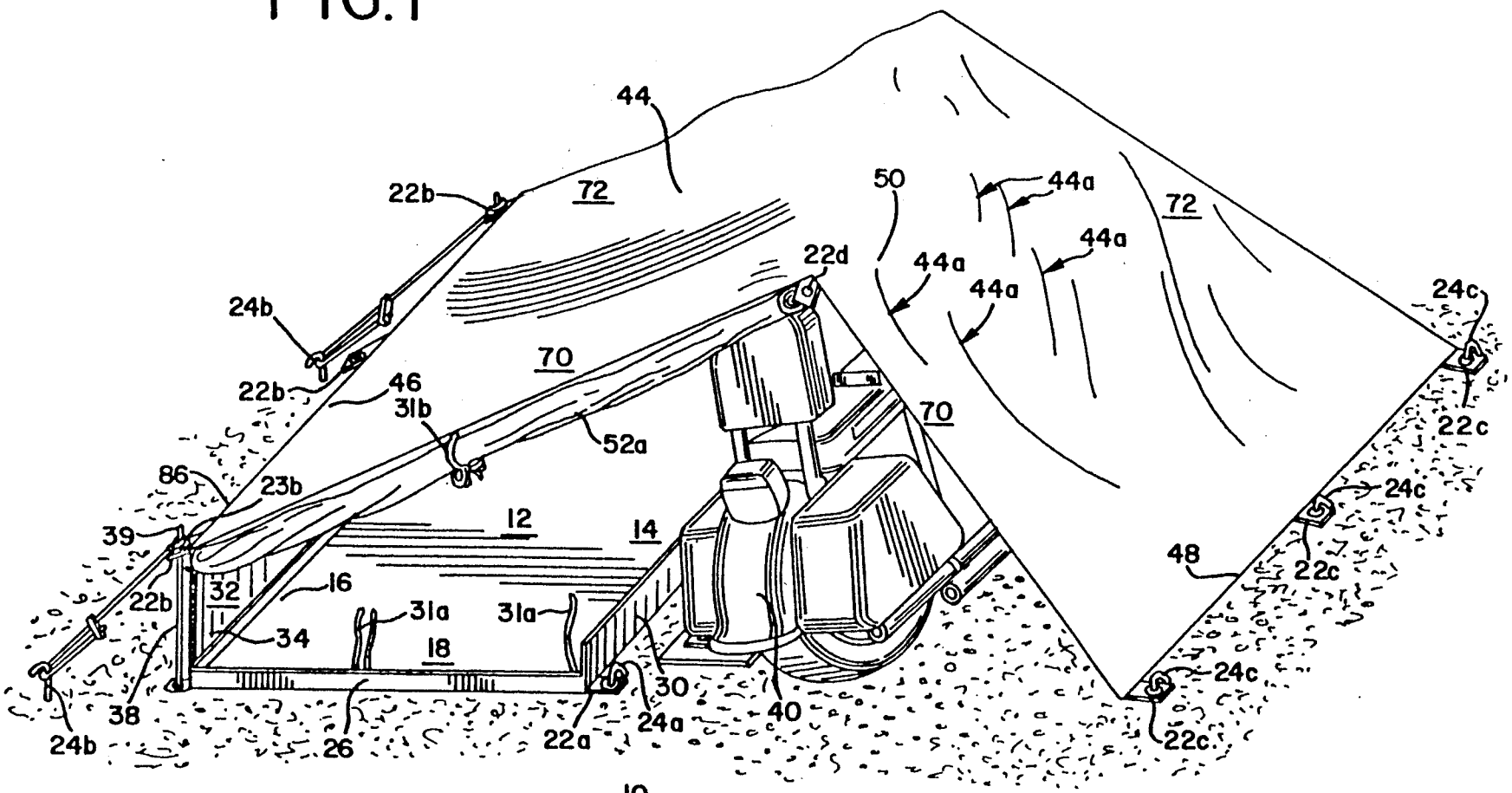
FIG. 1 is a perspective view of the tent assembly of the present invention in a set-up state; and, FIG. 2 is an exploded view of the tent assembly shown in FIG. 1.

While this invention is susceptible of embodiment in many different forms, there is shown in the drawings and will herein be described in detail a preferred embodiment of the invention. The present disclosure is to be considered as an exemplification of the principles of the invention and is not intended to limit the broad aspect of the invention to the embodiment illustrated.

As shown in both the figures, the tent assembly, generally designated by reference number 10, is designed to shelter one or more people and to enclose a vehicle. The assembly 10 includes a generally rectangular floor section 12 that has two substantially parallel sides 14,16 and two substantially parallel ends 18,20. The floor section 12 is positioned on the ground along the side of the vehicle, shown here as a motorcycle 40, and extends from one side 14, adjacent the motorcycle, to an opposing side 16 away from the motorcycle 40. The two sides 14,16 are spaced apart so as to permit one or two people to comfortably lay thereon in a position generally parallel to a side of the motorcycle 40. In practice, it has been found that a distance between the sides 14, 16 of the floor section 12 of approximately four feet and a distance of the floor section 12 between the two ends 18,20 of approximately eight feet is adequate and comfortable.

While a motorcycle is shown in the figures and discussed herein, it is appreciated that the assembly of the present invention can be used with other personal riding vehicles, such as a bicycle, a three wheel all terrain vehicle (ATV) or a snowmobile.

A plurality of grommeted tabs **22*a* are integrally connected to the sides 14, 16 of the floor section 12. These grommeted tabs 22*a* are spaced apart and are preferably connected at positions adjacent to the ends 18,20. Accordingly, tent stakes 24*a*** can be driven through the openings 23*a* of the grommeted tabs 22*a* and into the ground to firmly secure the floor section 12 in a fully expanded manner to the ground.

The floor section 12 further has separate, generally short upwardly extending end walls 26, 28 integrally connected to the ends 18, 20 of the floor section 12. Preferably, these end walls 26, 28 are approximately three inches in height. A separate, generally short upwardly extending side wall 30 is integrally connected to the side 14 of the floor section 12 positioned adjacent to the vehicle 40. In practice, it has been found that a side wall 30 of approximately six inches in height is sufficient. Ties 31*a* that are made of braided cord can be attached to the two end walls 26, 28 and to the side wall 30 to further secure the tent assembly 10 to the motorcycle 40. As discussed hereinafter, these ties 31*a* can alternatively be used to secure other elements of the tent assembly to each other.

Integrally connected to the side 16 of the floor section 12 farthest from the motorcycle 40 is a wall section 32. This wall section 32 has both a bottom edge 34 and a top edge 36 with the connection to the floor section 12 being to the bottom edge 34. Grommeted tabs 22*b* are connected to the top edge 36 at opposing ends of the top edge 36 of the wall section 32 and at a position midway between the opposing ends.

To support one side of the assembly 10, tent poles 38 are provided that have a top portion 39 with a circumferentially smaller cross section than the lower portion. Thus, the top portion 39 of each pole 38 can be inserted into an opening 23*b* of a grommeted tab 22*b*, and the pole positioned so as to hold the wall section 32 in a generally vertical, outstretched position. Tension lines 42 are secured to the top portions 39 of the tent poles 38 and to the ground by tent stakes 24*b* in order to maintain the poles in the upright position. Preferably, each such stake 24 is driven into the ground at a distance away from the tent assembly so as to ensure that the tension lines 42 are kept taut. It has been found that a wall section approximately two feet in height, namely, the distance between the bottom and top edges 34, 36 and approximately eight feet from end to end, is adequate. Similarly, the poles 38 used in conjunction therewith are at least two feet in length.

A generally rectangular roof section 44 having two sides 46,48 and two ends 70,72 is integrally connected at one of its sides 46 to the top edge 36 of the wall section 32. The roof section 44 is large enough to extend over both the floor section 12 and the motorcycle 40. An intermediate portion 50 of the roof section 44 between the sides 46, 48 is directly supported by the motorcycle 40. Being of a non-rigid material, such as a lightweight canvas, this intermediate portion 50 partially conforms to the shape of the uppermost portion of the motorcycle 40. This conforming is shown generally by the conforming lines 44*a* in the roof section 44.

A grommeted tab 22*d* is integrally connected to each end 70,72 of the roof section 44 at a point proximate the intermediate portion 50.

The opposing side 48 of the roof section 44 has a plurality of grommeted tabs 22*c* integrally connected thereon at positions adjacent the ends 70,72 and at a point midway therebetween. Tent stakes 24*c* can thus be driven through the openings 23*c* of the grommeted tabs 22*c* and into the ground on the side of the motorcycle 40 opposite the side of the motorcycle 40 where the floor section 12 is positioned. Accordingly, with this arrangement, the roof section 44 generally covers the entire motorcycle 40 and the entire floor section 12 so as to shelter both the vehicle and a person or two positioned on the floor section. Preferably, it has been found that a roof section having a transverse width from side to side of approximately eleven feet and a longitudinal length from end 70 to end 72 of approximately eight feet, is sufficient.

Figure 2:
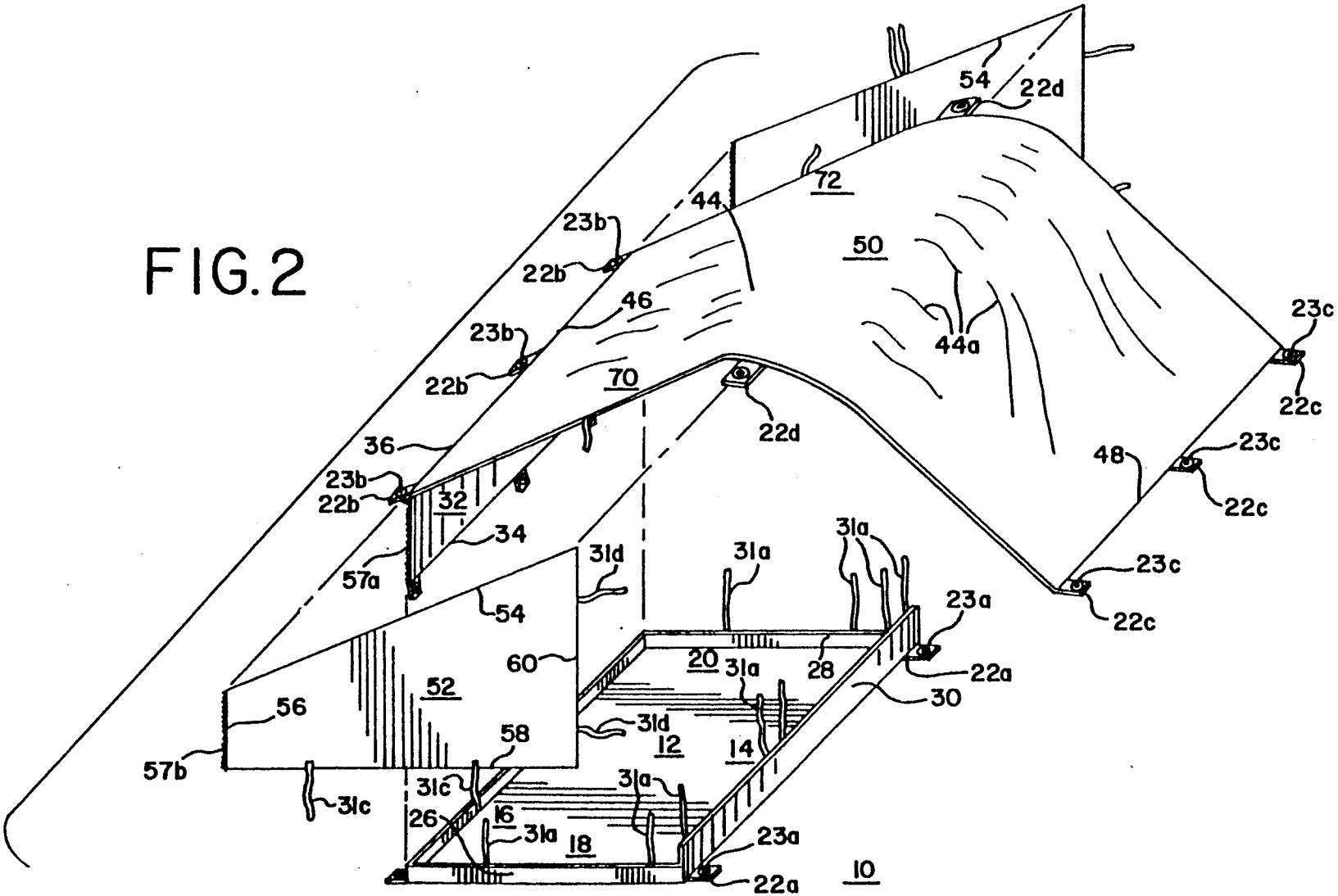

Storm flaps 52 that are integrally connected to and hang down from the ends 70,72 of the roof section 44, are shown in their entirety in FIG. 2. These flaps 52 are preferably only connected to a portion of the ends 46 of the roof section 44 and are trapezoidal in shape. Each of these flaps 52 extend along the ends from the edge of the side 46 of the roof section 44 to a point proximate the intermediate portion 50 of the roof section 44.

Further, to secure and maintain each flap 52 in its desired position, zippers and ties are provided. In particular, a first zipper portion 57*b* is attached to a side 56 of the flap 52 to mate with a second zipper portion 57*a* attached to an end of the wall section 32. In this manner, the corners formed between the wall sections 32, roof section 44 and flap 52 can be sealably closed to keep unwanted things, such as small animals, insects and rain out of the assembly when the flap is down. Ties 31*c* are further provided on the flap to cooperate with corresponding ties 31*a* attached to the two end walls 26, 28.

Thus, each flap 52 can be extended downwardly to about the floor section 12 and secured in this position. On the other hand, the flap 52 can be unzipped from the wall section 32 (FIG. 1), rolled or folded up and secured to the end of the roof section 44 by ties 31*b*. A single tie 31*b* attached to the end of the roof section 44 at a point midway between the side 46 and the portion 50 supported by the motorcycle 40 is shown in FIG. 1.

Also, braided cord ties 31*d* connected to the side 60 of the storm flaps 52 opposite the side 56 connected to the wall section 32, can be used to secure the storm flaps 52 to the motorcycle 40.

Further, while the positioning and construction of the flaps have been shown secured to a portion of each end 70,72 of the roof section 44, flaps can, if desired, be similarly constructed on the remaining portions of each end flap. In this manner, the entire assembly can be sealed from the outside environment.

In the preferred embodiment, the assembly has the side 16 of the floor section 12 sewn to the bottom edge 34 of the wall section 32, the top edge 36 of the wall section 32 sewn to the end 46 of the roof section 44, and the edge 54 of the storm flaps 52 sewn to the sides of the roof section 44.

The tent assembly preferably has a tempertent floor section 12 and is made from a fireproof, water and mildew resistant, lightweight canvas.

The height of the wall section 32 is designed to be lower than most motorcycles and other vehicles so that when the assembly 10 is set up, a pitch is imparted to the portion of the roof section 4 that is positioned directly over the floor section 12, permitting rain water to naturally run off the tent assembly.

The tent assembly can be disassembled by removing the stakes and tent poles, and untying all the ties. The tent can then be rolled or folded up and stored in a compartment of the vehicle While the specific embodiments have been illustrated and described, numerous modifications come to mind without significantly departing from the spirit of the invention and the scope of protection is only limited by the scope of the accompanying claims.

What is claimed is:

1. A tent assembly for sheltering a personal riding vehicle and at least a person comprising:

a floor section having a first side and a second side opposed from said first side, said first side being positioned on the ground adjacent a first side of the vehicle and said second side being spaced from said first side a distance so as to permit a person to lay thereon generally parallel to said first side of the vehicle;

means for securing said floor section to the ground;

a wall section having both a bottom edge and a top edge, said bottom edge being connected to said second side of said floor section and extending generally upwardly from said floor section;

means for supporting said wall section in a substantially vertical position;

a roof section having a first side and a second side opposed from said first side, said first side of said roof section being connected to said top edge of said wall section, said roof section being spaced from said floor section and extending from said first side of said roof section over the vehicle so as to substantially cover both said floor section and the vehicle, said roof section having an intermediate portion abutting the vehicle disposed between said first side of said roof section and said second side of said roof section, said intermediate portion generally conforming to the shape of the uppermost portion of the vehicle, with the vehicle providing support for said intermediate portion;

means for securing said second side of said roof section to one of a second side of the vehicle and the ground; and two storm flaps each having a first end and a second end opposed to said first end, one said storm flap being connected at said first end to an end of said roof section adjacent said first side of said roof section and extending generally downward to about said floor section and said other storm flap being connected at said first end to an opposed end of said roof section and extending generally downward to about said floor section, both said flaps including means for attaching each to said wall section, to said floor section, and to the vehicle.

2. The tent assembly of claim 1 wherein said means for attaching said storm flaps to said wall section is a cooperating zipper assembly.

3. The tent assembly of claim 1 wherein said means for attaching said storm flaps to said floor section is a tie.

4. The tent assembly of claim 1 wherein said means for attaching said storm flaps to the vehicle is a tie.

5. The tent assembly of claim 1 further comprising a plurality of grommeted tabs attached to said sides of said floor section, to said top edge of said wall section and to said sides of said roof section.

6. The tent assembly of claim 5 wherein said means for securing said floor section to the ground are stakes driven through said grommeted tabs connected to said floor section.

7. The tent assembly of claim 1 wherein said means for supporting said wall section comprises a plurality of grommeted tabs connected to said top edge of said wall section, a plurality of upright poles inserted into said grommeted tabs, and means for maintaining said poles in an upright position.

8. The tent assembly of claim 1 wherein the tent assembly is constructed from a non-rigid, fireproof, water and mildew resistant material.

9. The tent assembly of claim 1 wherein said top edge of said wall section is lower than the height of the vehicle so that a pitch is imparted to said roof section permitting rain to fall off the tent assembly.

10. A tent assembly for enclosing a personal riding vehicle and providing shelter for at least a person comprising:

a floor section having a first side and a second side opposed from said first side, said first side being positioned on the ground adjacent a first side of the vehicle and said second side being spaced from said first side a distance so as to permit a person to lay thereon generally parallel to said first side of the vehicle;

means for securing said floor section to the ground;

a substantially vertical wall section having both a bottom edge and a top edge, said bottom edge being connected to said second side of said floor section and extending upwards from said floor section;

means for supporting said wall section in a generally upright position;

a roof section having a first side and a second side opposed from said first side, with said first side of said roof section being connected to said top edge of said wall section, said roof section being spaced from said floor section and extending from said first side of said roof section over the vehicle so as to substantially cover both said floor section and the vehicle, said roof section having an intermediate portion abutting the vehicle disposed between said first side and said second side, said intermediate portion generally conforming to the shape of the uppermost portion of the vehicle with the vehicle providing support for said intermediate portion;

means for securing said second side of said roof section to one of the vehicle and the ground;

two storm flaps each having a first end and a second end, one said storm flap being connected at said first end of said storm flap to an end of said roof section adjacent said first side of said roof section and extending downward to about said floor section and said other storm flap being connected at said first end of said other storm flap to an end of said roof section opposed from said end of said roof section adjacent said first side of said roof section and extending downward generally to about said floor section, both said storm flaps including means for attaching to said wall section to said floor section, and to said vehicle; and a plurality of grommeted tabs attached to said first side and said second side of said floor section, to said top edge of said wall section, and to said second side of said roof section.

11. The tent assembly of claim 10 wherein said means for securing said floor section to the ground are stakes driven through said grommeted tabs connected to said floor section.

12. The tent assembly of claim 10 wherein said means for supporting said vertical wall section comprises a plurality of upright poles inserted into said grommeted tabs connected to said top edge of said wall section, a plurality of stakes driven into the ground and a plurality of tension lines attached to the tops of said poles and tautly secured to the ground by said stakes.

13. The tent assembly of claim 10 wherein said means for attaching said storm flaps to said wall section is a cooperating zipper assembly.

14. The tent assembly of claim 10 wherein said means for attaching said storm flaps to said floor section is a tie.

15. The tent assembly of claim 10 wherein the means for attaching said storm flaps to said vehicle is a tie.

16. The tent assembly of claim 10 wherein said tent assembly is constructed from a non-rigid, fireproof, water and mildew resistant material.

17. A tent assembly made from a non-rigid, fireproof, water and mildew resistant material for sheltering a motorcycle and at least a person comprising a rectangular shaped floor section having a first side and a second side opposed from said first side, with said first side being positioned on the ground adjacent said motorcycle and said second side being spaced from said first side a distance so as to permit a person to lay thereon generally parallel said motorcycle, said floor section having a plurality of grommeted tabs connected to said first side and said second side, a wall section in a substantially upright position having a bottom edge and a top edge, said bottom edge being integrally connected to said second side of said floor section and having a plurality of grommeted tabs connected to said top edge, a roof section having a first side and a second side opposed to said first side of said roof section, with said first side of said roof section being integrally connected to said top edge of said wall section, said roof section being spaced from said floor section and extending from said first side of said roof section over the motorcycle so as to substantially cover both the floor section and the motorcycle, said roof section having an intermediate portion abutting said motorcycle disposed between said first side of said roof section and said second side of said roof section, said intermediate portion generally conforming to the shape of the uppermost portion of said motorcycle, with said motorcycle providing support for said intermediate portion, a plurality of grommeted tabs connected to said second side of said roof section, means for connecting said second side of said roof section to one of said motorcycle and the ground, and two storm flaps each having a first end and a second end with said first end of one said storm flap being integrally connected to an end of said roof section adjacent said first side of said roof section and said first end of said other storm flap being integrally connected to the end of said roof section opposing said adjacent end, with each of said storm flaps extending generally downward to about said floor section and including means for attaching said storm flaps to said wall section, to said floor section, and to said motorcycle.

18. The tent assembly of claim 17 wherein said means for attaching said storm flaps to said wall section is a cooperating zipper assembly.

19. The tent assembly of claim 17 wherein said means for attaching said storm flaps to said floor section is a tie.

20. The tent assembly of claim 17 wherein said means for attaching said storm flaps to said motorcycle is a tie.

21. The tent assembly of claim 17 wherein said means for attaching said second side of said roof section to one of said motorcycle and the ground is a tie.

22. The tent assembly of claim 17 wherein said means for attaching said second side of said roof section to one of said motorcycle and the ground are stakes inserted through said grommeted tabs connected to said second side of said roof section and driven into the ground.

23. The tent assembly of claim 17 wherein said top edge of said wall section is lower than the height of said motorcycle so that a pitch is imparted to said roof section permitting rain to fall off said tent assembly.

* * * * *